United States Patent [19]

Spera

[11] 4,451,025

[45] May 29, 1984

[54] HAND RAILING ASSEMBLY

[75] Inventor: Vittorio Spera, Quebec, Canada

[73] Assignee: Speral Aluminium Inc., Quebec, Canada

[21] Appl. No.: 469,762

[22] Filed: Feb. 25, 1983

[30] Foreign Application Priority Data

Sep. 16, 1982 [CA] Canada ..... 411579

[51] Int. Cl.[3] ..... E04H 17/14

[52] U.S. Cl. ..... 256/65; 256/22

[58] Field of Search ..... 256/65, 59, 22

[56] References Cited

U.S. PATENT DOCUMENTS

| | | | |
|---|---|---|---|
| 3,498,589 | 3/1970 | Murdock | 256/70 |
| 3,689,032 | 9/1972 | Von Wedel et al. | 256/22 |
| 3,858,850 | 1/1975 | Maxcy et al. | 256/22 |
| 3,879,017 | 4/1975 | Maxcy et al. | 256/65 |
| 3,918,686 | 11/1975 | Knott et al. | 256/59 |
| 3,962,774 | 6/1976 | Noro | 29/432 |
| 3,982,735 | 9/1976 | Foruells | 256/59 |
| 4,014,520 | 3/1977 | Walters | 256/22 |
| 4,334,671 | 6/1982 | De Guise | 256/65 |
| 4,390,165 | 6/1983 | Murdock | 256/65 |

FOREIGN PATENT DOCUMENTS 778130 2/1968 Canada .

*Primary Examiner*—Andrew V. Kundrat

*Attorney, Agent, or Firm*—Fetherstonhaugh & Co.

[57] ABSTRACT

A hand railing assembly is provided which can be assembled on site without the use of screws and rivets and has covers to protect the interlocking joints from rain and the like. The assembly has a hand rail, a bottom rail, a plurality of spaced apart vertical posts, each post having a top end connected to the hand rail and a lower end for mounting in a supporting device, and a plurality of vertical pickets spaced between the posts, each picket having a top end connected to the hand rail and a lower end connected to the bottom rail. The improvement comprises a hand rail support strip extending along the length of the hand rail having poles spaced apart along the length to hold the top ends of the posts and pickets, a member having a T-shaped cross section, the member having a stem with sides sloped downwards and outwards, to slide into locating slots in the top ends of the pickets and posts, the member having a top flange whose ends slide in side slots in the hand rail support strip to lock the hand rail support strip to the top ends of the posts and pickets, a hand rail cap slidingly engaging and locking the hand rail support strip to cover the hand rail support strip, the member and the top ends of the posts and pickets, a bottom rail support strip extending along the length of the bottom rail having holes spaced apart along the length to hold the posts and the lower ends of the pickets, and a member having the same T-shaped cross section as that used with the hand rail support strip, inverted to slide into locating slots in the lower ends of the pickets between the posts, the member having an inverted top flange whose ends slide in side slots in the bottom rail support strip to lock the bottom rail support strip to the lower ends of the pickets.

6 Claims, 7 Drawing Figures

Fig. 1
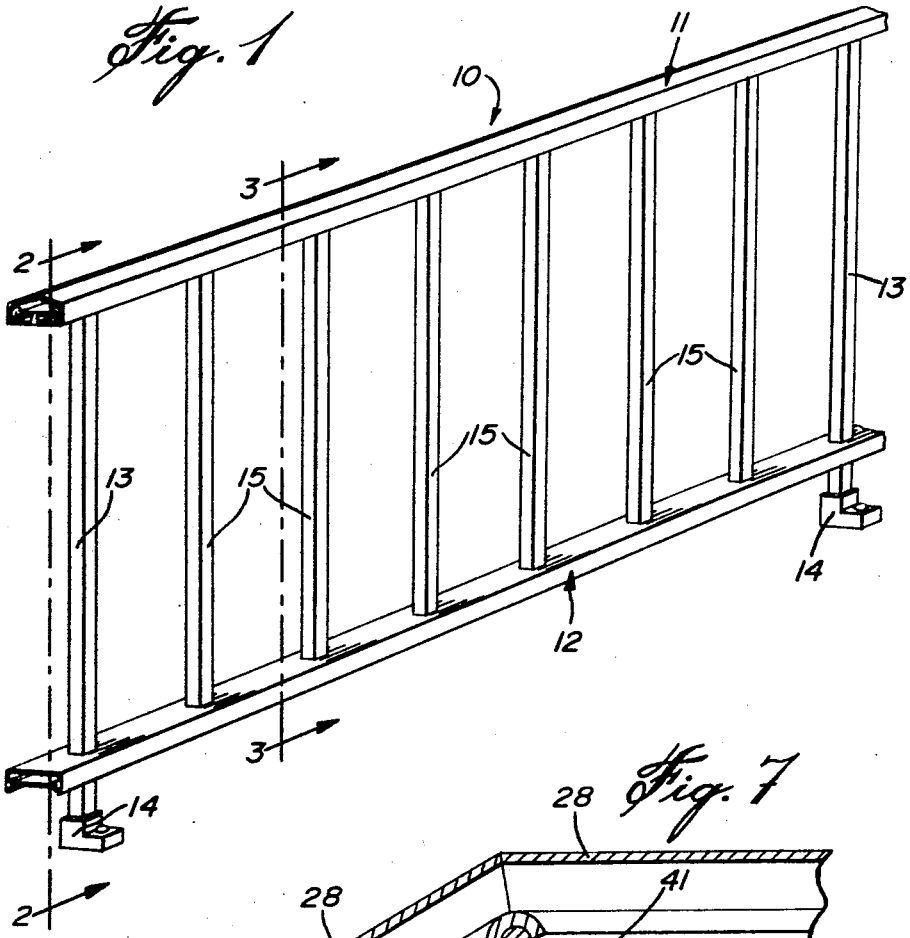
Fig. 7
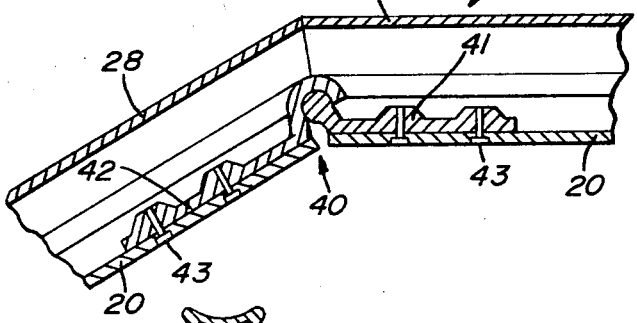
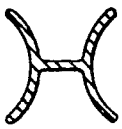
Fig. 4
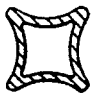
Fig. 5
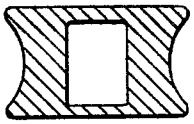
Fig. 6

HAND RAILING ASSEMBLY

The present invention relates to hand railing for balconies and the like. More specifically, the present invention provides a hand railing assembly having interlocking components that do not require screws, rivets and the like.

Hand railing assemblies are used on balconies for apartments and houses, they are also used on stairways both inside and outside buildings. In the past such railings have been made from steel members and are often welded. However, recently extruded aluminum sections have been used for hand rail assemblies. The use of aluminum sections usually avoids the necessity of welding the railing, and allows the railings to be easily assembled on site rather than welded in an assembly plant. Most aluminum railings use special extrusions but still require screw or rivet attachments to hold the rails and pickets to the posts. Alternatively, if they are interlocking extruding sections then invariably the joins between interlocking sections remain exposed to rain and dirt. When water collects in the cracks between these interlocking sections and freezes damage can occur to the railing, and it is almost impossible to separate the sections.

The present invention provides a hand railing assembly using sections which may be of extruded aluminum sections that require no screws or rivets to hold the sections together and that use a minimum number of sections to make a hand railing. Furthermore, all the interlocking sections are carefully covered to prevent moisture and dirt entering the cracks between the sections. This enables the hand railing assembly to be disassembled if and when necessary.

The interlocking sections of the hand railing assembly may be assembled by non-skilled persons, and installation time is reduced because there are no screws or rivets needed except at corners.

The present invention provides in a hand railing assembly having a hand rail, a bottom rail, a plurality of spaced apart vertical posts, each post having a top end connected to the hand rail and a lower end for mounting in a support means, a plurality of vertical pickets spaced between the posts, each picket having a top end connected to the hand rail and a lower end connected to the bottom rail, the improvement comprising a hand rail support strip extending along the length of the hand rail having holes spaced apart along the length to hold the top ends of the posts and pickets; a member having a T-shaped cross section, the member having a stem with sides sloped downwards and outwards, to slide into locating slots in the top ends of the pickets and posts, the member having a top flange whose ends slide in side slots in the hand rail support strip to lock the hand rail support strip to the top ends of the posts and pickets; a hand rail cap slidingly engaging and locking the hand rail support strip to cover the hand rail support strip, the member and the top ends of the posts and pickets; a bottom rail support strip extending along the length of the bottom rail having holes spaced apart along the length to hold the posts and the lower ends of the pickets; and a member having the same T-shaped cross section as that used with the hand rail support strip, inverted to slide into locating slots in the lower ends of the pickets between the posts, the member having an inverted top flange whose ends slide in side slots in the bottom rail support strip to lock the bottom rail support strip to the lower ends of the pickets.

In drawings which illustrate the embodiments of the invention,

FIG. 1 is an isometric view of a hand railing assembly according the the present invention.

FIGS. 4, 5 and 6 are cross sections of pickets and posts for the hand railing assembly.

FIG. 7 is a cross section through a hand rail showing a hinge assembly for a vertical change of direction.

Figures 2, 3:
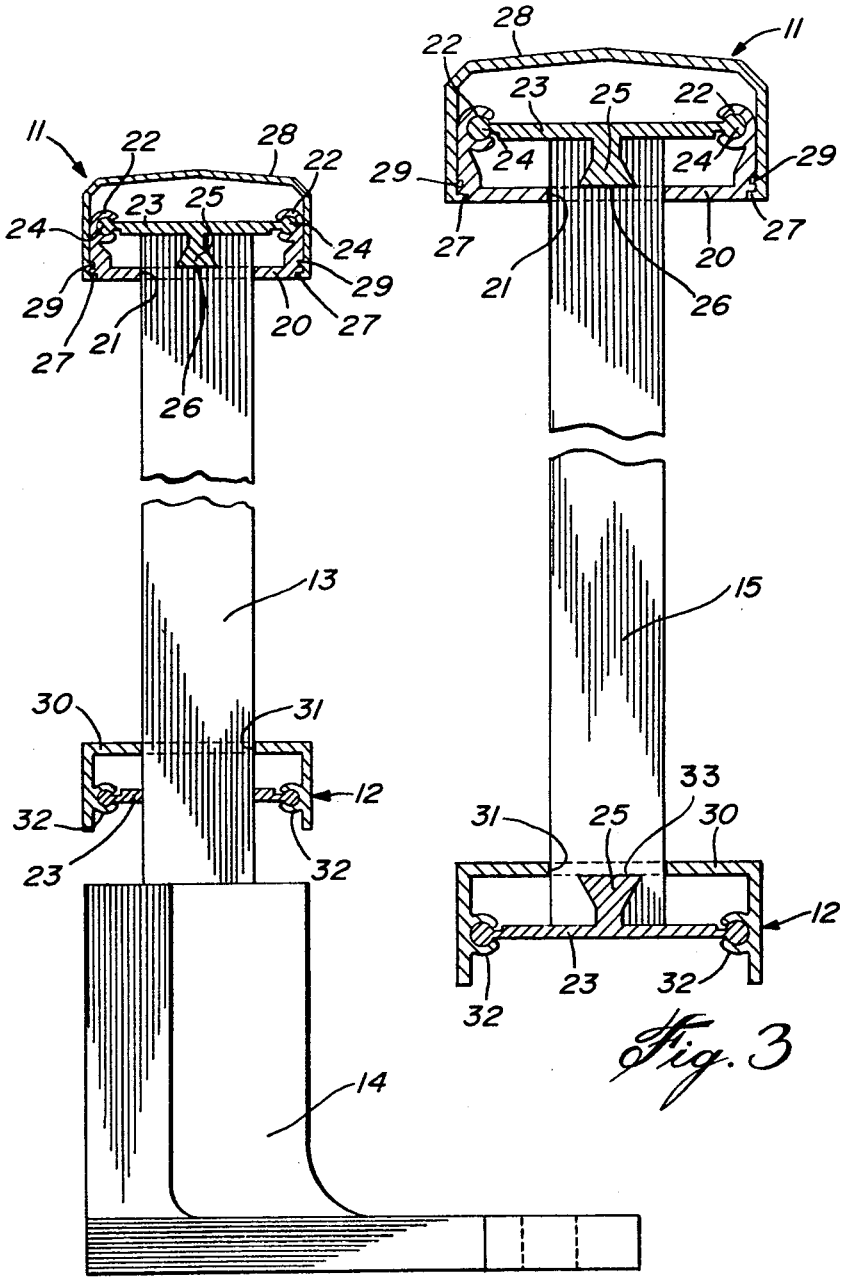
FIG. 2 is a cross sectional elevation through the post taken at line 2—2 of FIG. 1.
FIG. 3 is a cross sectional elevation through a picket taken at line 3—3 of FIG. 1.

Referring now to FIGS. 1-3, the hand railing assembly 10 includes a hand rail 11, a bottom rail 12, vertical posts 13 which extend down below the bottom rail 12 and have mounting shoes 14 to support the hand railing assembly 10. Vertical pickets 15 are located between posts 13 as illustrated in FIG. 1. The spacing between adjacent pickets 15 is substantially the same as is the spacing between a picket and an adjacent post. However, these spacings may be changed if desired.

The hand rail 11 comprises a hand rail support strip 20 which extends along the length of the hand rail. The support strip 20 has holes 21 positioned along the length at the desired spacings to exactly fit the cross sections of the posts 13 and the pickets 15. The hand rail support strip 20 has a channel shaped cross section with the flanges having on the inside keyhole slots 22 at their end. The slots 22 extend along the length of the strip 20. A member 23 having a T-shaped cross section, a top flange, each end of which terminates in a key 24 which slides in the slot 22 on each side of the strip 20. The stem 25 of the member 23, has at its bottom portion, sides which slope downwards and outwards to form a wedge shape. Cooperating slots 26 are cut in the top end of the posts 13 and pickets 15 so that after the post 13 or picket 15 is pushed through the hole 21 in the strip 20, the keys 24 of the member 23 are slid in the keyhole slots 22 of the strip 20 and the wedge-shaped stems 25 fit into the cooperating slots 26 at the top end of each post 13 and picket 15 to lock and wedge the posts 13 and pickets 15 to the hand rail support strip 20. External grooves 27, outside and at each end of the hand rail support strip 20 section, allows a hand rail cap 28 with mating ridges 29 to fit over the hand rail support strip 20 and slide longitudinally onto the strip 20, thus completely covering the handrail support strip 20, the member 23 and the top ends of the posts 13 and pickets 15. No cracks between interlocking sections occur on the top or side surfaces of the hand rail 11.

The bottom rail 12 comprises a bottom rail support strip 30 having a channel configuration which extends for the length of the railing assembly and has holes 31 positioned along the length at the desired spacings to exactly fit the cross sections of the posts 13 and pickets 15. Keyhole slots 32 on the inside of the flanges forming the bottom rail support strip 30 support a member 23 having an identical cross section to that used with the hand rail 11. The member 23 is inverted such that the wedge-shaped stem 25 fits into cooperating slots 33 cut in the lower ends of the pickets 15 to lock and wedge the lower ends of the pickets 15 to the bottom rail support strip 30. The cooperating slots 33 are cut only in the lower ends of the pickets 15 and not in the posts 13. The member 23 extends only underneath the pickets so the posts 13 can extend down beneath the bottom rail 12 into the mounting shoe 14 for supporting the hand railing assembly.

In one embodiment the member 23 extends for the full length of the hand rail 11 extending through each cooperating slot 26 securing and locking each post 13 and picket 15 to the hand rail support strip 20. In another embodiment individual members 23 are used to secure and lock each individual post 13 and picket 15 to the hand rail support strip 20. Similarly, the member 23 may extend for the distance between posts in the bottom rail 12 but not underneath the posts or, alternatively, individual members 23 may be used to secure and lock each individual picket 15 to the bottom rail support strip 30.

FIG. 4 and FIG. 5 show two different embodiments of picket cross section. An I-shaped configuration is shown in FIG. 4 with concave flanges and a generally square configuration with the concave sides is shown in FIG. 5. A post is shown in FIG. 6 having two concave sides and two flat sides. The post is usually heavier and stronger than the picket as it has to support the hand railing assembly. It is preferred that the material of construction is aluminum and these shapes shown in FIGS. 4, 5 and 6 together with the other shapes may all be extruded. Thus the minimum number of elements are needed for a hand rail assembly. The member 23 is an extruded member and may be used for both the hand rail and the bottom rail.

A hinge assembly 40 is shown in FIG. 7 for the hand rail 11 to provide a vertical change of direction for the hand railing assembly. There are two mating components 41, 42 of the hinge portion, each component being joined to the hand rail support strip 20 and attached by means of screws 43. The two components form a hinge which allows any angle, either upwards or downwards, to accommodate stairs, ramps and the like. The hand rail cap 28 for both sides of the vertical change in direction is cut so that they mate exactly and no space is left between the hand rail. Thus, in all cases the hinge assemblies are protected as are the top ends of the pickets and posts together with the member. Corners of any desired angle for the hand rail may be made, and in all cases the rail caps 28 are cut so that the edges mate and protect the top support strips 20.

Various changes may be made to the elements shown in the drawings without limiting the scope of the present application which is restricted only by the following claims.

The embodiments of the invention in which an exclusive property or privilege is claimed are defined as follows:

1. In a hand railing assembly having a hand rail, a bottom rail, a plurality of spaced apart vertical posts, each post having a top end connected to the hand rail and a lower end for mounting in a support means, a plurality of vertical pickets spaced between the posts, each picket having a top end connected to the hand rail and a lower end connected to the bottom rail, the improvement comprising, a hand rail support strip extending along the length of the hand rail having holes spaced apart along the length to hold the top ends of the posts and pickets;

a member having a T-shaped cross section, the member having a stem with sides sloped downwards and outwards, to slide into locating slots in the top ends of the pickets and posts, the member having a top flange whose ends slide in side slots in the hand rail support strip to lock the hand rail support strip to the top ends of the posts and pickets;

a hand rail cap slidingly engaging and locking the hand rail support strip to cover the hand rail support strip, the member and the top ends of the posts and pickets;

a bottom rail support strip extending along the length of the bottom rail having holes spaced apart along the length to hold the posts and the lower ends of the pickets; and a member having the same T-shaped cross section as that used with the hand rail support strip, inverted to slide into locating slots in the lower ends of the pickets between the posts, the member having an inverted top flange whose ends slide in side slots in the bottom rail support strip to lock the bottom rail support strip to the lower ends of the pickets.

2. The hand railing assembly according to claim 1 wherein the member having the T-shaped cross section on the hand rail extends for the length of the hand rail support strip.

3. The hand railing assembly according to claim 1 wherein the member having the T-shaped cross section for the hand rail comprises short lengths for the top ends of the pickets and posts, and the member for the bottom rail comprises short lengths for the lower ends of the pickets.

4. The hand railing assembly according to claim 1 wherein the pickets have a substantially square cross section with concave sides.

5. The hand railing assembly according to claim 1 wherein the pickets have a substantially I-shaped cross section with concave flanges.

6. The hand railing assembly according to claim 1 including a hinge means attached to the hand rail support strip to provide a vertical change of direction for the hand railing assembly.

* * * * *